United States Patent [19]

Myklebust et al.

[11] Patent Number: 4,584,705

[45] Date of Patent: Apr. 22, 1986

[54] FLEXIBLE CONTAINER

[75] Inventors: Eirik Myklebust; Anders Juel; Odd F. Rasmussen, all of Porsgrunn, Norway

[73] Assignee: Norsk Hydro a.s., Oslo, Norway

[21] Appl. No.: 638,611

[22] Filed: Aug. 7, 1984

[30] Foreign Application Priority Data

Sep. 1, 1983 [NO] Norway ..... 833138

[51] Int. Cl.[4] ..... B65D 33/06; B65D 33/16

[52] U.S. Cl. ..... 383/8; 383/121; 383/126; 383/907

[58] Field of Search ..... 383/7, 8, 121, 126, 383/907

[56] References Cited

U.S. PATENT DOCUMENTS

| | | | |
|---|---|---|---|
| 3,119,548 | 1/1964 | Cook et al. | 383/7 |
| 4,136,723 | 1/1979 | Skaadel et al. | 383/7 |
| 4,223,709 | 9/1980 | Myklebust | 383/8 |
| 4,269,247 | 5/1981 | Omdal | 383/8 |
| 4,312,392 | 1/1982 | Sekiguchi | 383/8 |
| 4,521,911 | 6/1985 | Vance | 383/24 |

FOREIGN PATENT DOCUMENTS

| | | | |
|---|---|---|---|
| 26288 | 8/1981 | European Pat. Off. | 383/7 |
| 26287 | 8/1981 | European Pat. Off. | 383/7 |
| 2729155 | 1/1975 | Fed. Rep. of Germany . | |
| 2927939 | 1/1981 | Fed. Rep. of Germany . | |
| 278276 | 10/1927 | United Kingdom . | |
| 1168677 | 10/1969 | United Kingdom . | |
| 1475019 | 6/1977 | United Kingdom | 383/8 |

*Primary Examiner*—Stephen P. Garbe

*Attorney, Agent, or Firm*—Wenderoth, Lind & Ponack

[57] ABSTRACT

A flexible container for filling, transport and storage of bulk material is made from at least one piece of base material. The bottom of the container is formed from at least four paired, preferably equally large, flaps which are direct extensions of the container side walls. The bottom flaps are formed by cut lines in the piece of material, and the angles $\alpha$ and $\beta$ of alternate flaps converge toward the center of the bottom. The sum of top angles $\alpha$ and $\beta$ of the flaps is less than 360°, such that the container bottom formed by joints of the flaps is downward slightly cone or funnel shaped when the container is filled. The sum of the angles $\alpha$ and $\beta$ of the flaps preferably is between (240°–280°) and 360°. The container bottom will be substantially square or rectangular, depending on whether $\alpha=\beta$ or $\alpha\neq\beta$. Each of the bottom seams can terminate at a distance from the center of the bottom such that there are no seams in a minor area around the center, and in this area there can be arranged a discharge spout.

6 Claims, 9 Drawing Figures

FLEXIBLE CONTAINER

BACKGROUND OF THE INVENTION

The present invention relates to flexible containers for filling, transport and storage of bulk material, Such containers can be made from flat-woven or round-woven base material, and the container bottom is formed for at least four paired, preferably equally large, flaps which are direct extensions of the container side walls. When the base material is joined together, at least one integrated lifting-loop can be made at the same time.

Containers, also called intermediate bulk containers, of the above mentioned type have been used for some time and have proved to be suitable for several purposes. An inner liner of impervious material is often used in use a container, and when they are to be filled with free-flowing bulk material, the container and the liner are usually first inflated by air. In Norwegian Pat. No. 138.134 (corresponding to U.S. Pat. No. 4,136,723 shows such a container having a double bottom. It is preferably equipped with two integrated lifting-loops having a total width substantially equal to half the circumference of the container such that the lifting-loops comprise all the longitudinal fibers of the container. The container can be filled by using an apparatus described in British Pat. No. 1,505,583 and it is then standing on a base without any extra support. Its lifting-loops can also be placed on a hook or the like before the container is inflated and filled with bulk material. The container can be made ready for further transport after filling. This can comprise closing the liner and gathering the lifting-loops together such that a suitable loop is formed and which easily can be placed on a hook or similar ligting device by pressing the lifting-loops together and securing them in this position. Before filling of bulk material, the container can be equipped with a permanent lifting grip.

However, it was found that inflating the container before filling at the filling station, especially when dusty bulk material should be filled, had some disadvantages as the air has to be displaced by the bulk material. The air which is pressed out will then contain dust from the bulk material and pollute the environment around the filling apparatus. When the bulk material is dusty, one must therefore use a dust removing device on the filling pipe, and the air sucked away is led to a dust filter for cleaning the air. Such a dust removing device complicates the filling apparatus and can hardly be made efficient without reducing the filling capacity of the apparatus. The fact that filling apparatuses having dust removing devices are not available everywhere where filling of such containers with dusty bulk materials will take place has accordingly limited the use of these containers.

It is known that containers having a central lashing knot in the bottom can be filled with fluidizable, dusty bulk material without preliminary inflation by hanging the container by its lifting-loops on a hook before filling. The central positioning of the lashing knot on such containers automatically ensures that the bulk material during the start of the filling is placed centrally at the container bottom and then gradually fills the container evenly all the way up without making the container lopsided.

If one tries to fill a container as described in the above Norwegian patent in the same way, i.e. without preliminary inflation with air, one will in some cases succeed, but in other cases the container bottom will be filled unevenly such that the whole container becomes lopsided. A further problem, especially with fluidizable bulk material, is that the inner liner will be pressed out between the bottom flaps into the double bottom.

However, because of the good experience with containers having integrated lifting-loops, it is desirable to continue with such a container construction, but to shape the container such that it would not have to be inflated at the filling station before it is filled with bulk material. Even though containers having a central lashing knot in the bottom are well suited for substantially dust-free filling of fluidized, dusty bulk material, without preliminary inflation at the filling station, when hanging by their lifting loops on a hook, they also have certain disadvantages.

During discharge of such containers, which normally is made by cutting the bottom by a knife or the like, the following can occur:

(a) The whole lashing knot will leave with the bulk material.

(b) A relatively large amount of fibers from the container will leave with the bulk material and pollute it because of the large concentration of container material or cloth which is present in the central part of the bottom.

(c) There are formed pockets on the outside of the lashing knot if it is not cut, completely out such that a complete discharge of the container must be made manually.

SUMMARY OF THE INVENTION

An object of the present invention is to provide a container which can be filled, when it is hanging by its lifting-loop, with bulk material which will be evenly distributed in the container without having to employ preliminary inflation of the container at the filling station. Another object of the invention is to provide such a container that can be emptied completely in a simpler manner than prior containers, without getting large amounts of fiber from the container material into the bulk material when the container bottom is cut open, and that can be completely emptied without the need for extra manual work.

When containers of the type described in the previously mentioned Norwegian patent were more thoroughly investigated, it was found that one of the greatest disadvantages was that the bulk material was not evenly distributed during filling, especially during the first part of the filling process. In order to get a better centering of the bulk material during the starting phase of the filling, the inventors therefore tried to change the shape of the container. It was then found that the greatest effect was achieved by amending the container bottom. If the bottom was made such that the lower part of the container became cone or funnel shaped, the bulk material would automatically be centered from the start of the filling operation. However, it was desired to avoid application of a flashing knot which has the disadvantages previously mentioned.

The inventors were able to construct a bottom which forms a funnel at the start of the filling, and the bulk material was then automatically centered and thereafter evenly and gradually filled into the container without making it lopsided. At the same time a bottom was obtained which, especially at the end of the emptying process, was at a dominantly funnel form such that the container was completely emptied without manual work. The bottom construction according to the invention also avoids concentration of container material in the central part of the bottom such that only a small amount of fibers can follow the bulk material and pollute it during discharge of the container.

The present invention is the result of further development of an intermediate bulk container according to the previously mentioned Norwegian Pat. No. 138.134. The known container had a double bottom, and the question was raised as to how much weaker the new bottom construction, which is not double, would be. It surprisingly was found that by constructing the bottom such that in the lower part of the base material from which the container was made there are cuts at angles with the side edges, such that there are formed at least four paired, preferably equally large, flaps which are joined together such that the joining lines cross each other or meet at the central part of the bottom, there will be formed a bottom which is stronger or at least as strong as the previously known double bottom. The special features of the flexible container according to the invention are that when the bottom consists of at least four paired, preferably equally large, flaps which are direct extensions of the container side walls and are joined along the cutting lines, the joining lines will cross each other or meet in the central part of the bottom. The total area of the bottom flaps will be larger than that required for forming a flat bottom, such that when the container is completely inflated, i.e. filled with bulk material or air, its bottom will be slightly cone or funnel shaped. Such a bottom is obtained when the sum of the angles defined by the edges of the flaps is less than 360°.

The most preferred embodiment is a container having a square bottom, and the bottom flaps are then formed by cutting the lower part of the container material along lines which form four equally large flaps such the angles $\alpha$, $\beta$ of alternate flaps have the relationship that $\alpha=\beta<90°$.

The container bottom can also be rectangular and have for instance four flaps. Then, two of the flaps will have angles $\alpha$ and two will have angles $\beta$, with $\alpha\neq\beta$ and $(2\alpha+2\beta)<360°$.

BRIEF DESCRIPTION OF THE DRAWINGS

The construction of the container of the invention and a method for its manufacture will be further explained in the following description, including an example which shows testing of a container according to the invention and one according to the above U.S. patent, with reference to the accompanying drawings, wherein.

DETAILED DESCRIPTION OF THE INVENTION

Figure 1:
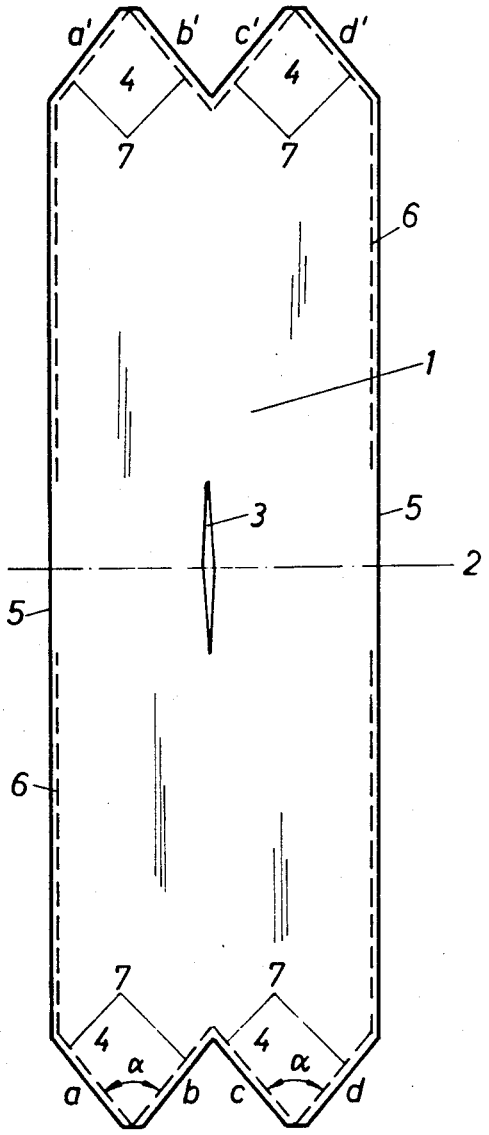
FIG. 1 shows a flat-woven base material for making a flexible container having a square bottom formed by four bottom flaps.
Figure 4:
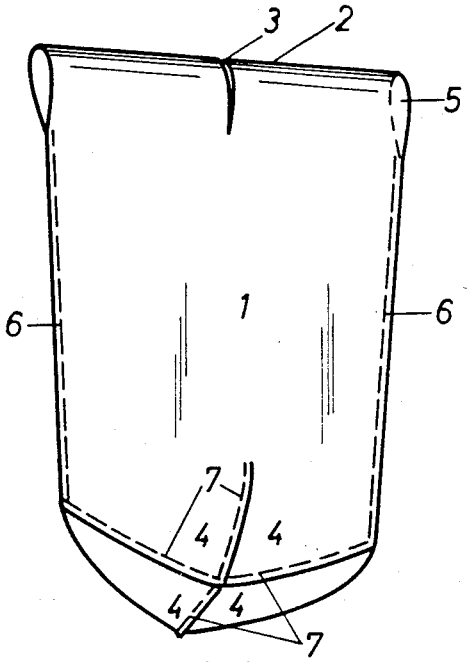
FIG. 4 shows a completed container made from a piece of base material as shown in FIG. 1.

In FIG. 1 is shown an unfolded piece of base material (1) which is doubled by folding along folding edge (2). Cuts for forming a filling opening (3) and for forming the flaps (4) along cut lines (a,b), (c,d), (a40 , b'), and (c', d') are made respectively at opposite sides of the folding edge (2) and at the oposite ends of piece 1 preferably after the piece of base material has been floded along edge 2. The cut lines (a,b), (c,d), (a', b') and (c', d') form the flaps (4), and the cut lines of each flap extend at an angle $\alpha$. All the flaps (4) are equally large, and the bottom thereby will have a square form, as shown in FIG. 4. The cut lines define flaps with pointed, anqular free ends.

Figure 2:
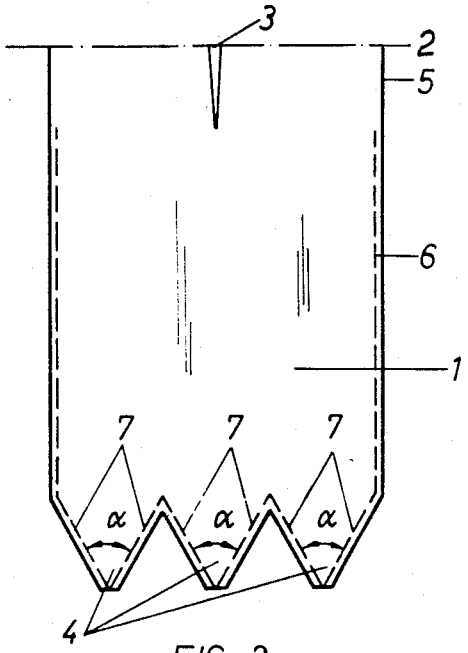
FIG. 2 shows a flat-woven base material for making a flexible container having a hexagonal bottom formed by six bottom flaps.
Figure 9:
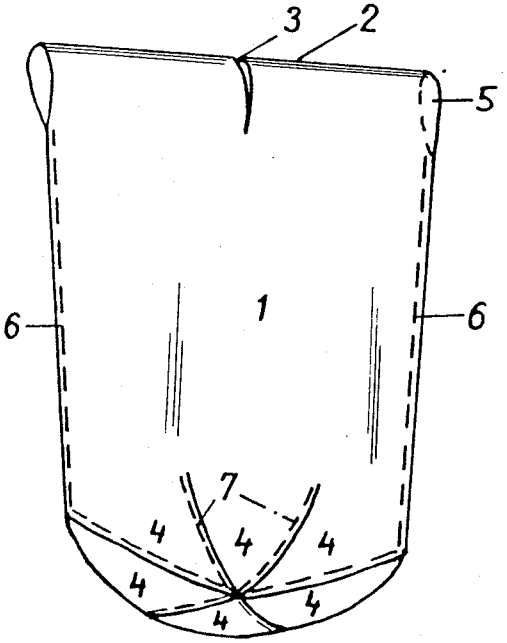
FIG. 9 shows a completed container made from a piece of base material according to FIG. 2.

FIG. 2 shows one of two equally large halves of a piece of base material (1) with filling opening (3), side edges (6) and opening (5) forming a lifting-loop. In each half there are made incisions or cuts for forming three equal bottom flaps (4) defined by cut lines extending at angles $\alpha$. By joining together adjacent edges of the flaps, a hexagonal bottom with six bottom seams 7 is formed, since all the angles $\alpha$are equal. Pairs of seams 7 form three diagonal bottom seams, of which one will be a direct extension of side seams (6) of the container as shown in FIG. 9.

Figure 3:
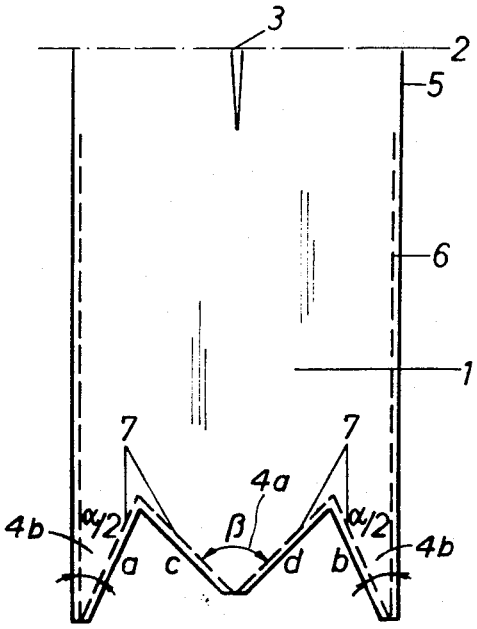
FIG. 3 shows a flat-woven base material for making a container having a rectangular bottom.
Figure 5:
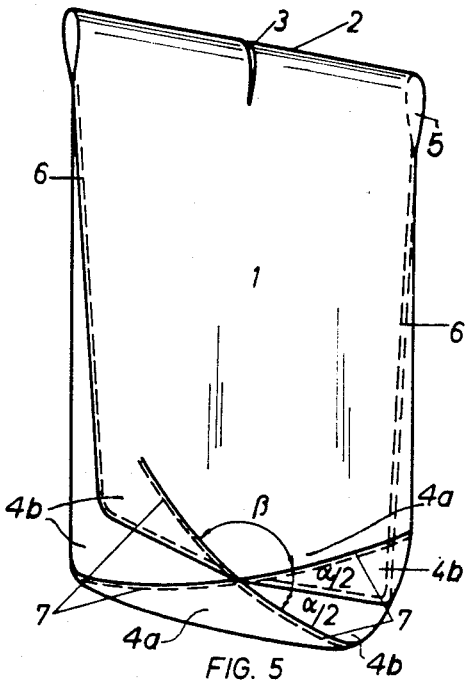
FIG. 5 shows a completed container made from a piece of base material according to FIG. 3.

FIG. 3 shows one of two equal halve of a piece of base material (1) for making a container having a rectangular bottom. In this arrangement angles $\alpha$ and $\beta$ of alternate flaps are formed such that $\alpha\neq\beta$ and the central flap 4*a* will be shorter and wider than a bottom flap which is formed by two outer half flaps 4*b*. As a result, there will be formed a rectangular bottom when the flaps 4*a*, 4*b* are joined together as shown in FIG. 5, with the outer half flaps 4*b* joined along seams which will be extensions of the side seams (6). Cut lines b and a form angles $\alpha/2$ with their respective side edges (6). If $\alpha=\beta<90°$, then there will be formed square bottom having a total of six bottom seams, two of which will be extensions of the side seams which join the respective outer half flaps 4*b*.

FIG. 4 shows a container having a square bottom and made from a flat-woven piece of base material (1), as shown in FIG. 1, folded around a folding edge (2) and joined by said side seams (6) and bottom seams (7). As can be seen from this figure, two of the bottom seams (7) will be continuous extensions of the side seams (6). If the piece of base material (1) consists of two pieces joined in the vertical direction as viewed in FIG. 1, the container will have four bottom seams (7) which are extensions of the respective side seams (6).

Figure 6:
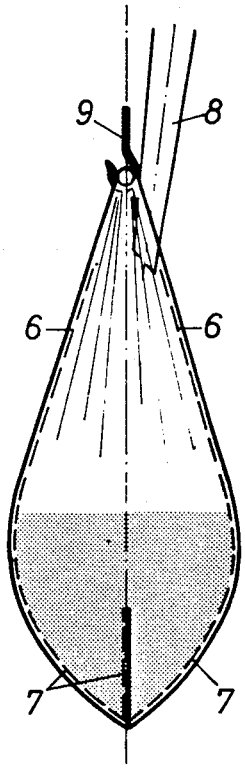
FIG. 6 shows a container according to the invention during filling thereof with fluidized bulk material.

FIG. 6 shows a container partly filled with fluidizable material, for instance cement, the container hanging by its lifting loops in a hook (9) and being filled through a pipe (8). As can be seen from this figure, the container bottom has a marked conical shape, and the fluidizable material is centered during filling and is evenly distributed in the container.

Figure 7:
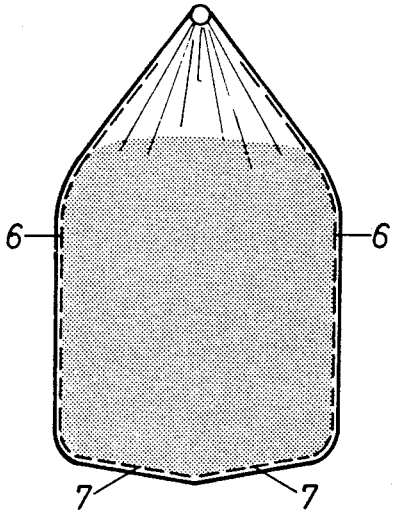
FIG. 7 shows a section through a hanging, filled container.

FIG. 7 shows a cross sectional view of a hanging container filled with free-flowing material and ready for storage of transport. The bottm is not flat but is slightly cone or funnel shaped. The illustrated container is made by joining four defined by cut lines extending at angles $\alpha$ of about 80°.

The piece of material (1) may also be cut up in such a way as to provide more than six bottom flaps (4), for instance such as eight or more bottom flaps (4).

When the piece of material (1) consists of a round or tubular woven member, such member can be arranged in such a way that the container either has side seams and lifting-loops without seams, or without side seams but then with sewn lifting-loops.

The cut lines and thereby the bottom seams (7) can deviate from the illustrated straight lines as the cut lines can consist of straight lines or curves, but then there will be a hypothetical line through the wave shaped joints which form the angles $\alpha$ or $\beta$, respectively.

The new bottom construction according to the invention may also be applied to other types of flexible containers, for instance those having lifting-loops sewn on to them or those having integrated lifting-loops which have a total width less than half of the container's circumference.

Figure 8:
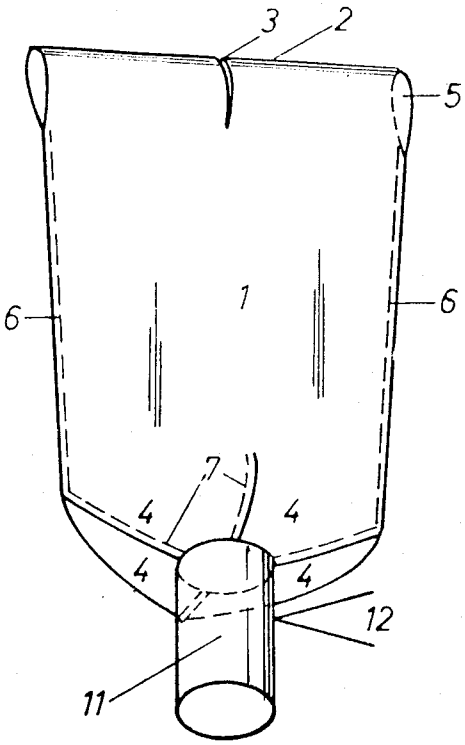
FIG. 8 is a view similar to FIG. 4, but modified to show a bottom discharge spout.

In a special embodiment of the invention, the bottom seams (7) are interrupted such that in the central part of the bottom there will be a small area without seams, but apart from this the bottom will be as shown on FIGS. 4 or 5. Such embodiment has been found to have certain advantages during discharge of the container, for instance a discharge spout 11 can be arranged to extend through the area without seams as shown in FIG. 8, and be closed conventionally, e.g. by a tie rope 12.

Tension comparison tests were carried out between containers made according to the invention and containers according to Norwegian Pat. No. 138.134, i.e. U.S. Pat. No. 4,136,723.

Each container was first filled with about 950 kg of freeflowing material and placed on a hook in a rack. On top of the free-flowing material inside the container was placed a disk of steel which was secured to the base (the floor) by means of a steel rod. The steel rod went through the free-flowing material and the container bottom. The hook could be hoisted/lowered by means of a hydraulic cylinder. Between the hook and the cylinder was mounted a weighing cell which registered the tension to which the containers were exposed. The progress of the tension was registered by means of a recorder, and maximum load at rupture was shown on a digital instrument.

The containers were first stretched three times to about 2/5 of a probable load for rupture and then were stretched till rupture occurred. The load at rupture and the place of rupture (bottom or top) are listed in the following table, where also the different test containers' tensile strength is given relative to containers made according to Norwegian Pat. No. 138.134. The test containers 1.3, 1.4, 3.3, 3.4, 3.5 and 3.6 are outside the scope of the invention, as $\alpha=\beta\leqq 90°$. The test containers Nos. 3.11 and 3.12 are containers having six bottom seams and $\alpha=\beta=80°$, as the bottom flaps are cut in a manner similar to that shown in FIG. 8, with four equally large bottom flaps of which two are formed by sewing together respective two half flaps 4*b*.

The test containers Nos. 1.1–1.6 are made from woven polypropylene cloth haivng a dimension of 160×212 cm (plane width×length), an net volume was about 0.8 $m^3$.

The containers Nos. 1.1 and 1.2 are standard containers according to Norwegian Pat. No. 138.134 from the producer.

The containers Nos. 1.3–1.6 are the same type of containers, but having modified bottom constructions, i.e. signle layer bottoms with diagonal bottom seams.

The test containers Nos. 3.1–3.12 were all produced at the applicant's test station from differently woven polypropylene (pp) cloth than the containers 1.1–1.6, but with the same dimensions. All the containers which were tested had bottoms which consisted of four bottom flaps. The results from the tests are shown in the following table.

TABLE I

| Container No. | Container construction | Place of rup. | Rupt. load (kN) | Average rupt. load (kN) | Rupt. load rel. to cont. acc. to NO Patent No. 138.134 |
|---|---|---|---|---|---|
| 1.1 | Acc. to NO Patent No. 138.134 | Bottom | 67.7 | 67.1 | 100% |
| 1.2 | Acc. to NO Patent No. 138.134 | Top | 66.6 | | |
| 1.3 | Bottom having diagonal seams $\alpha = \beta = 90°$ | Bottom | 62.9 | 62.3 | 92.5% |
| 1.4 | Bottom having diagonal seams $\alpha = \beta = 90°$ | Top | 61.8 | | |
| 1.5 | Bottom having diagonal seams $\alpha = \beta = 80°$ | Top | 79.9 | 78.0 | 116% |
| 1.6 | Bottom having diagonal seams $\alpha = \beta = 80°$ | Bottom | 76.2 | | |
| 3.1 | Acc. to NO Patent No. 138.134 | Bottom | 69.1 | 70.2 | 100% |
| 3.2 | Acc. to NO Patent No. 138.134 | Top | 71.3 | | |
| 3.3 | Bottom having diagonal seams $\alpha = \beta = 98°$ | Bottom | 56.6 | 59.2 | 84% |
| 3.4 | Bottom having diagonal seams $\alpha = \beta = 98°$ | Bottom | 61.8 | | |
| 3.5 | Bottom having diagonal seams $\alpha = \beta = 90°$ | Top | 63.4 | 64.8 | 92% |
| 3.6 | Bottom having diagonal seams $\alpha = \beta = 90°$ | Top | 66.3 | | |
| 3.7 | Bottom having diagonal seams $\alpha = \beta = 85°$ | Top | 75.3 | 76.9 | 109.5% |
| 3.8 | Bottom having diagonal seams $\alpha = \beta = 85°$ | Bottom | 78.6 | | |
| 3.9 | Bottom having diagonal seams $\alpha = \beta = 80°$ | Top | 78.5 | 75.9 | 108% |
| 3.10 | Bottom having diagonal seams $\alpha = \beta = 80°$ | Bottom | 73.4 | | |
| 3.11 | Bottom having diagonal seams $\alpha = \beta = 80°$ 6 bottom seams | Bottom | 72.1 | 71.3 | 101.5% |
| 3.12 | Bottom having diagonal seams $\alpha = \beta = 80°$ 6 bottom seams | Bottom | 70.5 | | |

The test results clearly show that the new bottom construction makes it possible to expose a filled flexible container according to the invention to a larger load than the known container according to Norwegian Pat.

No. 138.134, 8% to 16% respectively, with four bottom seams, while it is at least equally strong by choosing four equally large bottom flaps, of which two are formed from two half flaps.

Further, the test results clearly show that the construction of the container must be such that the sum of the angles of the flaps is less than 360° in order to get maximum utilization of the bottom construction for the flexible container according to the invention. When comparing containers with bottom flaps with angles of $\alpha=90°$ with containers according to the invention at angles $\alpha=85°-80°$, it is shown that the containers according to the invention can endure 18–25% higher load than containers having angles $\alpha=90°$.

Further attempts for determining the limits of the angles showed that there is no precise upper limit. The practical lower limit for such angles will be that the sum of the angles of the flaps is 240°–280°. For the upper limit, however, it was found that a positive effect is achieve as soon as the sum of such angles was below 360°.

Practical attempts of filling fluidized cement into flexible containers according to the invention, without preliminary inflation of the container at the filling station, have shown that the funnel which forms at the container bottom at the start of the filling automatically centers the fluidized cement and then gradually fills the container without making it lopsided when the container is filled while hanging freely from a hook as shown in FIG. 6.

Formation of dust during filling of fluidized cement into such containers was so small that it was not necessary to have a special dust removing device on the filling pipe.

During discharge of the containers filled with cement one could observe that the containers were completely emptied without any significant manual work, and that pollution by fibers from the container was minimal.

Flexible containers according to the invention are not just stronger than or at least as strong as containers according to Norwegian Pat. No. 138.134, but they are also simpler to manufacture, as the total length of seams is not substantially longer (about 15%) and the new bottom construction does not require more material. Because it can endure higher loads, the container according to the invention can be made from lighter and thereby cheaper material, such that the extra cost for slightly more seams will be more than compensated.

We claim:

1. In a flexible container for the filling, transportation and storage of bulk material, said container being of the type including an upper section having at least one lifting loop, side walls and a bottom, with said bottom being formed by a least four flaps which are direct extensions of the material of said side walls, the improvement comprising:

each said flap being defined by rectilinear side edges which extend at an angle to each other and converge at a pointed free flap end;

said flaps being oriented with said free flap ends directed centrally of said bottom, and adjacent said side edges of said flaps being joined to thereby define bottom seams and to form said bottom of a single thickness of said material; and the sum of said angles defined by said side edges of all of said flaps being less than 360°, such that said container bottom when filled will have a slightly downwardly converging conical or funnel shape.

2. The improvement claimed in claim 1, comprising four said flaps of equal size, and said angles $\alpha$ of all said flaps being equal, wherein $70° \leqq \alpha < 90°$, such that said bottom has a generally square form.

3. The improvement claimed in claim 1, comprising six said flaps of equal size, and said angles $\alpha$ of all said flaps being equal, wherein $40° \leqq \alpha < 60°$, such that said bottom has a generally hexagonal form.

4. The improvement claimed in claim 1, comprising four said flaps including a first pair of alternate flaps each having a respective said angle $\alpha$ and a second pair of alternate flaps each having a respective said angle $\beta$, wherein $\alpha \neq \beta$, such that such bottom has a generally rectangular form.

5. The improvement claimed in claim 1, wherein said sum is between 240° and 360°.

6. The improvement claimed in claim 1, wherein said bottom seams each terminate at a position spaced from the center of said bottom.

* * * * *